US007627878B2

(12) United States Patent
Pouliot et al.

(10) Patent No.: US 7,627,878 B2
(45) Date of Patent: Dec. 1, 2009

(54) METHOD AND SYSTEM FOR AUTOMATED AUDITING OF ADVERTISING

(75) Inventors: Jean-Francois Pouliot, Outremont (CA); Jean Charles Dupuis, Outremont (CA); Geoffrey Bastien, St-Bruno (CA)

(73) Assignee: Eloda Inc., Montreal, Quebec (CA)

( * ) Notice: Subject to any disclaimer, the term of this patent is extended or adjusted under 35 U.S.C. 154(b) by 264 days.

(21) Appl. No.: 11/613,822

(22) Filed: Dec. 20, 2006

(65) Prior Publication Data

US 2007/0157224 A1 Jul. 5, 2007

Related U.S. Application Data

(60) Provisional application No. 60/752,914, filed on Dec. 23, 2005.

(51) Int. Cl.

| | |
|---|---|
| ***H04H 20/14*** | (2008.01) |
| ***H04H 60/29*** | (2008.01) |
| ***H04H 9/00*** | (2006.01) |
| ***H04H 7/16*** | (2006.01) |

(52) U.S. Cl. ..... 725/22

(58) Field of Classification Search ..... 725/22
See application file for complete search history.

(56) References Cited

U.S. PATENT DOCUMENTS

| | | | | | |
|---|---|---|---|---|---|
| 3,919,479 | A | * | 11/1975 | Moon et al. | 704/237 |
| 4,025,851 | A | * | 5/1977 | Haselwood et al. | 725/22 |
| 4,230,990 | A | * | 10/1980 | Lert et al. | 725/22 |
| 4,420,769 | A | * | 12/1983 | Novak | 348/180 |
| 4,450,531 | A | * | 5/1984 | Kenyon et al. | 708/5 |
| 4,547,804 | A | * | 10/1985 | Greenberg | 348/460 |
| 4,677,466 | A | * | 6/1987 | Lert et al. | 725/22 |
| 4,739,398 | A | * | 4/1988 | Thomas et al. | 725/22 |
| 4,967,273 | A | * | 10/1990 | Greenberg | 725/22 |
| 5,162,905 | A | * | 11/1992 | Itoh et al. | 725/22 |
| 5,436,653 | A | * | 7/1995 | Ellis et al. | 725/22 |
| 5,437,050 | A | * | 7/1995 | Lamb et al. | 725/22 |
| 5,584,050 | A | * | 12/1996 | Lyons | 455/2.01 |
| 5,621,454 | A | * | 4/1997 | Ellis et al. | 725/22 |
| 6,002,443 | A | * | 12/1999 | Iggulden | 348/553 |
| 6,388,712 | B1 | * | 5/2002 | Shinohara et al. | 348/473 |
| 6,469,749 | B1 | * | 10/2002 | Dimitrova et al. | 348/722 |
| 6,574,594 | B2 | * | 6/2003 | Pitman et al. | 704/236 |
| 7,039,930 | B1 | * | 5/2006 | Goodman et al. | 725/22 |
| 7,039,931 | B2 | * | 5/2006 | Whymark | 725/32 |
| 7,064,796 | B2 | * | 6/2006 | Roy et al. | 348/700 |
| 7,194,752 | B1 | * | 3/2007 | Kenyon et al. | 725/22 |
| 7,421,723 | B2 | * | 9/2008 | Harkness et al. | 725/14 |
| 2002/0059580 | A1 | * | 5/2002 | Kalker et al. | 725/25 |
| 2005/0066352 | A1 | * | 3/2005 | Herley | 725/19 |

(Continued)

*Primary Examiner*—Christopher Kelley
*Assistant Examiner*—Mulugeta Mengesha
(74) *Attorney, Agent, or Firm*—Barley Snyder LLC

(57) ABSTRACT

The timing and placement of advertising on TV, radio or other broadcast media can be automatically verified or audited by monitoring and recording channels of TV, radio or broadcast media by storing and tagging discrete portions of segments of the broadcast signals in a database. A controller, or "dispatcher" server, dispatches the files to an analysis server for performing various mathematical comparisons and statistical correlations on the audio and video signals for positively identifying one or more advertisements of interest. A report is generated, providing particulars about the airing times of the advertisement of interest and whether its content exactly matches the content of a reference advertisement used as the basis for the mathematical comparisons and correlations.

27 Claims, 6 Drawing Sheets

U.S. PATENT DOCUMENTS

2005/0096926 A1* 5/2005 Eaton et al. ..... 705/1
2005/0195334 A1* 9/2005 Yeh et al. ..... 348/700
2006/0059277 A1* 3/2006 Zito et al. ..... 710/15
2006/0195863 A1* 8/2006 Whymark ..... 725/22
2007/0016918 A1* 1/2007 Alcorn et al. ..... 725/22
2007/0083883 A1* 4/2007 Deng ..... 725/19

* cited by examiner

*STEP 1 (Preliminary Frequency Matching)*

| Frequency Component (Hertz) | # of Detected Peaks | # of Peaks in Reference Signal | Preliminary Match? |
|---|---|---|---|
| 10,000 Hz | 5 | 5 | Yes |
| 1,000 Hz | 22 | 23 | Yes |
| 100 Hz | 19 | 18 | Yes |
| 10 Hz | 9 | 9 | Yes |

*STEP 2 (Complete Profile Matching)*

*STEP 3 (Complete Frequency Matching)*

| Frequency Component (Hertz) | # of Detected Peaks | # of Peaks in Reference Signal | Preliminary Match? |
|---|---|---|---|
| 10,000 Hz | 12 | 12 | Yes |
| 1,000 Hz | 47 | 48 | Yes |
| 100 Hz | 40 | 39 | Yes |
| 10 Hz | 21 | 21 | Yes |

| Attribute | Within Tolerance? | Correlation? | Match? |
|---|---|---|---|
| Red | Yes | Yes | Yes |
| Blue | Yes | No | No |
| Green | Yes | Yes | Yes |
| (Chromaticity) | (Yes) | (No) | (No) |
| Luminance (B/W) | Yes | Yes | Yes |

METHOD AND SYSTEM FOR AUTOMATED AUDITING OF ADVERTISING

CROSS-REFERENCE TO RELATED APPLICATIONS

This application claims priority under 35 U.S.C. §119(e) from U.S. Provisional Patent Application No. 60/752,914 entitled "Advertising Auditing System" filed on Dec. 23, 2005 by Dupuis et al.

TECHNICAL FIELD

The present invention relates generally to the monitoring of ads on television and other broadcast media, and in particular, to techniques for automatically monitoring and verifying the content and timing of ads that are aired.

BACKGROUND OF THE INVENTION

Increasingly, advertisers and media placement agencies track the timing and placement of their own advertisements using both manual and automated techniques to verify that the correct ad is aired on the right channel at the right time. Oftentimes, the advertiser will want to monitor the timing and placement of its ads in order to audit what is known in the industry as an "affidavit". The affidavit is typically received from the broadcaster as a form of invoice detailing which ads were aired at which time. In addition to monitoring the placement and timing of one's own ads, useful competitive intelligence can be gleaned by tracking the ads of competitors.

Prior art techniques for automated monitoring of advertisements on TV, radio, or other broadcast media (e.g. internet) typically require that a fingerprint or watermark be inserted into the ad to enable the ad to be identified. The fingerprint or watermark is designed to be recognizable to a signal analyzer or digital signal processor when specific filters are applied to the signal but without perceptibly distorting the signal, i.e. without degrading the audio or video. Inserting fingerprints or watermarks, however, requires that ads be processed before airing, thus representing an additional expenditure of time and money.

Recognition of broadcast segments without first implanting a fingerprint or watermark is also known in the art. U.S. Pat. No. 3,919,479 to Warren D. Moon, entitled BROADCAST SIGNAL IDENTIFICATION SYSTEM, which issued on Nov. 11, 1975, describes a process for automatic electronic recognition and identification of programs and commercial advertisements broadcast on television and radio wherein a digitally sampled reference signal segment derived from either the audio or video portion of the original program content to be identified is compared with successive digitally sampled segments of the corresponding audio or video portion of a broadcast signal in a correlation process. A signature is generated by sampling a low-frequency envelope of a predetermined size generated from a non-linear analog transform of the audio and video components of the broadcast signal, and digitizing the samples. Unfortunately the number of samples required to characterize the segment makes the signature cumbersome to match, and expensive to store.

Subsequently developed techniques for generating smaller signatures unfortunately characterize the segments poorly. A number of patents have taught signatures generated from one or only a few frames of the segment which does not necessarily mean that a match has been found.

For example, U.S. Pat. No. 6,002,443, entitled METHOD AND APPARATUS FOR AUTOMATICALLY IDENTIFYING AND SELECTIVELY ALTERING SEGMENTS OF A TELEVISION BROADCAST SIGNAL, which issued to Iggulden on Dec. 14, 1999, teaches the use of an average luminance value of select lines of a select frame of the segment. More specifically, 64 consecutive odd lines chosen after line 22 of an NTSC frame, of a $10^{th}$ frame after a segment transition event, are suggested for this purpose. The suggested signature is a small 64-bit value, one bit defined by each respective line, in relation to a threshold. While the signature is 64 bits long, it does not characterize more than the one frame of the segment, which is insufficient to determine with certainty whether an advertisement is in fact the one that is sought.

Another method of generating a signature for a broadcast segment is taught in U.S. Pat. No. 5,436,653 entitled METHOD AND SYSTEM FOR RECOGNITION OF BROADCAST SEGMENTS, which issued to Ellis on Jul. 25, 1998. This signature generation method involves calculating a difference vectors from average luminance values of pairs of predefined patches of pixels (both active and blanked) of the frame. There are 16 pairs of the patches, and consequently 16 difference values are calculated for each frame. Each of the 16 value difference vectors is subjected to a plurality of vector transformations to generate the signature. The method requires complicated video edge detection, sophisticated vector transformation algorithms designed to improve the differentiation of the resulting signatures, and jitter compensation to adaptively modify a portion of the patches used to generate the averages. While the invention provides a compact signature, the signature is represents only a few frames, which is insufficient to positively identify an ad with a high degree of certainty.

None of the prior art systems characterize a broadcast segment using features relating to its entire length while providing a reasonably-sized signature. Further, known systems fail to reliably distinguish two segments that have similar frame sequences, and misidentify common frame sequences in different segments. There therefore remains a need for a system that is largely immune to a broadcast signal's noise, jitter and instability, that efficiently and accurately characterizes substantially entire segments in order to automatically identify an advertisement with a very high degree of certainty so that automated auditing and verification reports can be generated quickly and accurately. Therefore, improvements to the prior art technology remain highly desirable.

SUMMARY OF THE INVENTION

An object of the present invention is to provide an improved method and system for automatically verifying the timing and placement of advertising on TV or other broadcast media. The system implements the associated method by monitoring and recording channels of TV, radio or broadcast media by storing and tagging discrete portions of segments of the broadcast signals in a database. A controller, or "dispatcher" server, dispatches the files to an analysis server for performing various mathematical comparisons and statistical correlations on the audio and video signals for positively identifying one or more advertisements of interest. A report is generated, providing particulars about the airing times of the advertisement of interest and whether its content exactly matches the content of a reference advertisement used as the basis for the mathematical comparisons and correlations.

Accordingly, an aspect of the present invention is a method of automatically verifying airing times and content of advertising. The method includes steps of receiving a broadcast signal upon which an advertisement of interest is scheduled to be carried. The method includes a subsequent step of analyzing the broadcast signal by comparing detected attributes of the broadcast signal with previously measured attributes of a reference signal representing an unmodified version of the advertisement of interest in order to determine whether the broadcast signal contains the advertisement of interest. Finally, the method includes a step of generating a report indicating whether the broadcast signal contained the advertisement of interest.

Another aspect of the present invention is a computer program product having software code adapted to perform the foregoing method when the computer program product is loaded into a memory of one or more servers and executed by processors resident within the one or more servers.

Yet another aspect of the present invention is a system for automatically monitoring and verifying advertisements. The system includes a recorder for recording a received broadcast signal and a database for storing files corresponding to discrete arbitrarily sized segments of the signal and for tagging the files with time and channel information. The system also includes a controller for dispatching the stored files from the database to an analysis server for analyzing the broadcast signal by comparing detected attributes of the broadcast signal with previously measured attributes of a reference signal representing an unmodified version of the advertisement of interest in order to determine whether the broadcast signal contains the advertisement of interest to enable generation of a report indicating whether the signal contains the advertisement of interest.

Yet a further aspect of the present invention is a method of verifying advertising that includes steps of comparing a received instance of an advertisement of interest to a reference advertisement and automatically generating an electronic report indicating whether the received instance of the advertisement of interest matches the reference advertisement, the report comprising an electronic proof embedded within the report, the electronic proof being extracted from the received instance of the advertisement of interest.

The method and system in accordance with these various aspects of the invention enable efficient, automated generation of reports for a variety of purposes, such as auditing broadcasters' affidavits to verify that ads aired as per the contract between the advertiser and broadcaster. The method and system can also be used to generate monitoring reports that detail airing times and ad content of an advertiser's advertising on one or more channels. Furthermore, the method and system can generate competitive intelligence reports detailing ad content and airing times of the advertising of one or more specified competitors.

BRIEF DESCRIPTION OF THE DRAWINGS

Further features and advantages of the present technology will become apparent from the following detailed description, taken in combination with the appended drawings, in which.

It will be noted that throughout the appended drawings, like features are identified by like reference numerals.

DETAILED DESCRIPTION OF THE EMBODIMENTS

Figure 1:
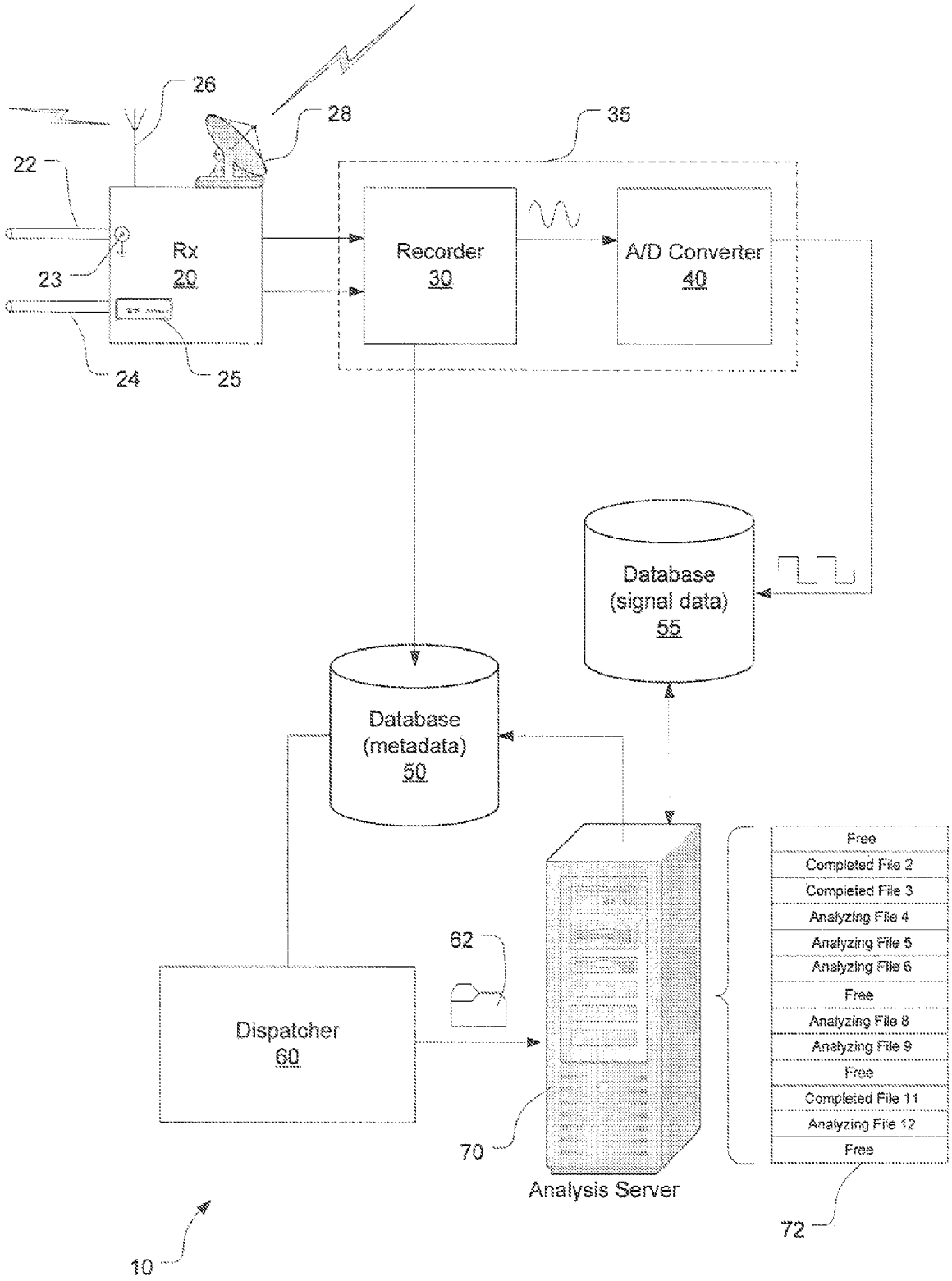
FIG. 1 is a block diagram schematically illustrating a system for monitoring and verifying timing and placement of advertisements in accordance with an embodiment of the present invention.

FIG. 1 is a block diagram schematically illustrating a system for monitoring and verifying the timing and placement of advertisements in accordance with an embodiment of the present invention. The system, generally designated by reference numeral 10, includes a receiver 20 for receiving one or more broadcast signals for one or more types of broadcast media. For example, as depicted, the receiver 20 can include one or more coaxial cable terminals 23 for connection to one or more coaxial cables 22 for receiving cable TV. The receiver 20 can include one or more modems 25 for receiving cable internet (or alternatively one or more DSL modems for receiving internet content over standard twisted-pair phone lines). As depicted, the receiver 20 can include an antenna 26 for receiving radio, over-the-air TV or wireless internet content. As further depicted, the receiver 20 can include a satellite dish 28 for receiving satellite TV, radio or internet content. In the preferred embodiment, the receiver includes a broadband fiber optic cable modem for receiving large numbers of channels of cable TV and/or radio. The receiver 20 should be able to receive both analog and digital signals, the former being digitized downstream of the receiver, as will be described below.

As further depicted in FIG. 1, the system 10 includes a recorder/ADC module 35 connected downstream of the receiver 20. The recorder/ADC module includes a recorder 30 and an analog-to-digital converter (ADC) 40 which may be integrated within the same module, as shown by the dashed lines representing the recorder/ADC 35, or these may be separate units. Received broadcast signals are recorded by one or more recorders. The recorder 30 captures the received broadcast signals in discrete segments or portions, storing these as digital files in a first database 55 (a "signal-data" database or "file server"), e.g. usually a bank of servers each having a large-capacity memory device, such as a hard-drive). In other words, segments or portions of the raw (brute) signal data are stored as digital files in the signal-data database 55 for being selectively uploaded to an analysis server 70 at the direction of a dispatcher 60, as will be explained below.

In parallel, as depicted in FIG. 1, the recorder 30 generates a file identifier for each recorded segment as well as appropriate metadata or "header information" (such as timestamps, file size, creation time, channel identification, bit rate, etc.) and transmits the identifier and metadata to a second database 50 for storage (the "metadata database"). In other words, each digital file (representing a segment) is "tagged" with appropriate identifiers and metadata information which enable searching, indexing, retrieval and analysis of particular data files, as will be elaborated below.

Typically, each recorder 30 will handle 16 cable TV channels. Thus, it is usually necessary to install a bank of parallel recorders to record, for example, all the cable TV stations available on all cable TV service providers for a given metropolitan area. Likewise, it is usually necessary to connect this bank of recorders 30 to a bank of hard-drives or other memory devices in order to store all the data.

As further depicted in FIG. 1, the optional analog-to-digital converter (ADC) 40, or "digitizer", digitally samples ("digitizes") the analog signals to create digital files for storage in the first database 55 (or file server). Because most current broadcast environments are a mix of digital and analog, this ADC 40 is included in the system for dealing with the analog signals. However, as the TV and radio industries move toward digital formats, the ADC 40 would, of course, become unnecessary in an environment where all the incoming signals are already in digital format.

As further depicted in FIG. 1, the system 10 includes a controller ("dispatcher" or "dispatcher server") 60 which dispatches digital files 62 representing segments of broadcasts to the analysis server 70 for analysis. Furthermore, it should be appreciated that each analysis server 70 can be a single server capable of parallel processing a plurality of digital files 62, or a plurality of networked servers capable of processing the digital files by performing mathematical comparisons and statistical correlations on the audio and/or video signals. The one or more analysis servers 70 store and execute analysis software that performs the computations and comparisons for determining whether any segment of the broadcast signal matches the advertisement of interest. The analysis server 70 can then generate automatically a report indicative of whether the advertisement of interest was aired at the scheduled time and/or whether the content of the ad exactly matched that of the advertisement of interest. Further details of the analysis methodology will now be described with regard to the method depicted in FIGS. 2-3, which the system 10, in essence, implements.

Figure 2:
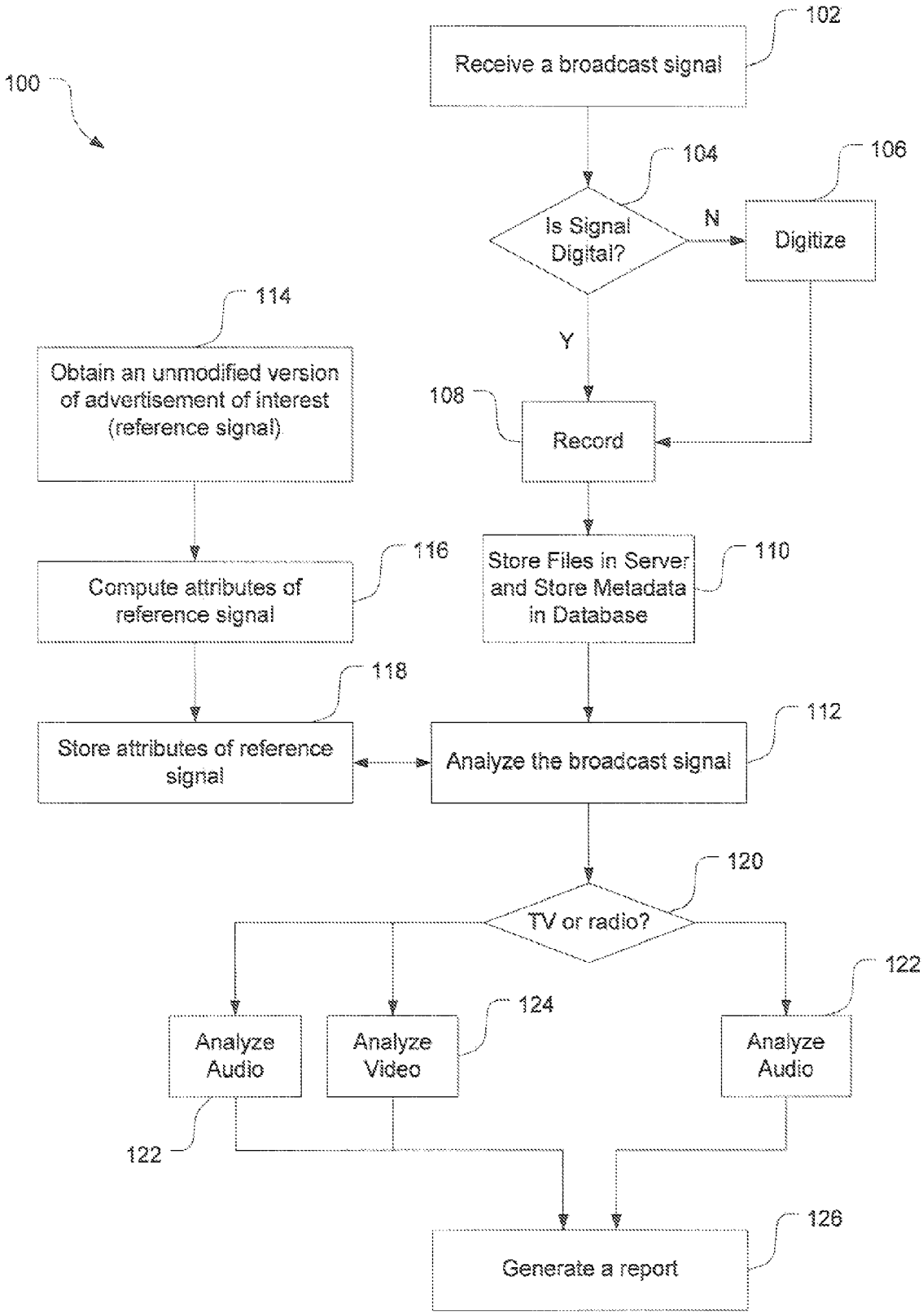
FIG. 2 is a flowchart depicting steps of a method of monitoring and verifying airing times and ad content of advertisements in accordance with an embodiment of the present invention.

FIG. 2 is a flowchart depicting steps of a method 100 of monitoring and verifying airing times and ad content of advertisements. As depicted schematically in FIG. 2, the method 100 includes a step 102 of receiving a broadcast signal 102 upon which an advertisement of interest is scheduled to be carried. After receiving the broadcast signal, the signal type (analog or digital) is determined (step 104). If the signal is analog, it is digitized (step 106). The digital (or digitized) signal is then recorded (step 108) by storing the raw data in digital files 62 in the server 70 while storing appropriate metadata in the database 50 (step 110).

The method 100 further includes a step 112 of analyzing the broadcast signal by comparing detected attributes of the broadcast signal with previously measured attributes of a reference signal representing an unmodified version of the advertisement of interest in order to determine whether the broadcast signal contains the advertisement of interest. As shown in FIG. 2, the attributes of the reference signal are determined by first obtaining an unmodified version of the advertisement of interest (step 114) and then computing the attributes (step 116) and then storing these attributes (step 118) for later retrieval and comparison with the signal attributes of the detected broadcast signal (step 112). Analysis will depend on whether a determination (step 120) as to whether the signal is a TV signal (having audio and video signal components) or a radio signal (having only audio). Audio analysis (step 122) and video analysis (step 124) are then performed (as will be elaborated below with regard to FIGS. 4 and 5). Finally, as depicted in FIG. 2, the method includes a step of generating a report indicating whether the broadcast signal contained the advertisement of interest. Preferably, the report is automatically generated based upon the mathematical comparisons (difference tolerances) and statistical correlations. Although the report is automatically generated, a human operator of the system may choose, out of prudence, to manually double-check any reported discrepancies in the generated report.

Figure 3:
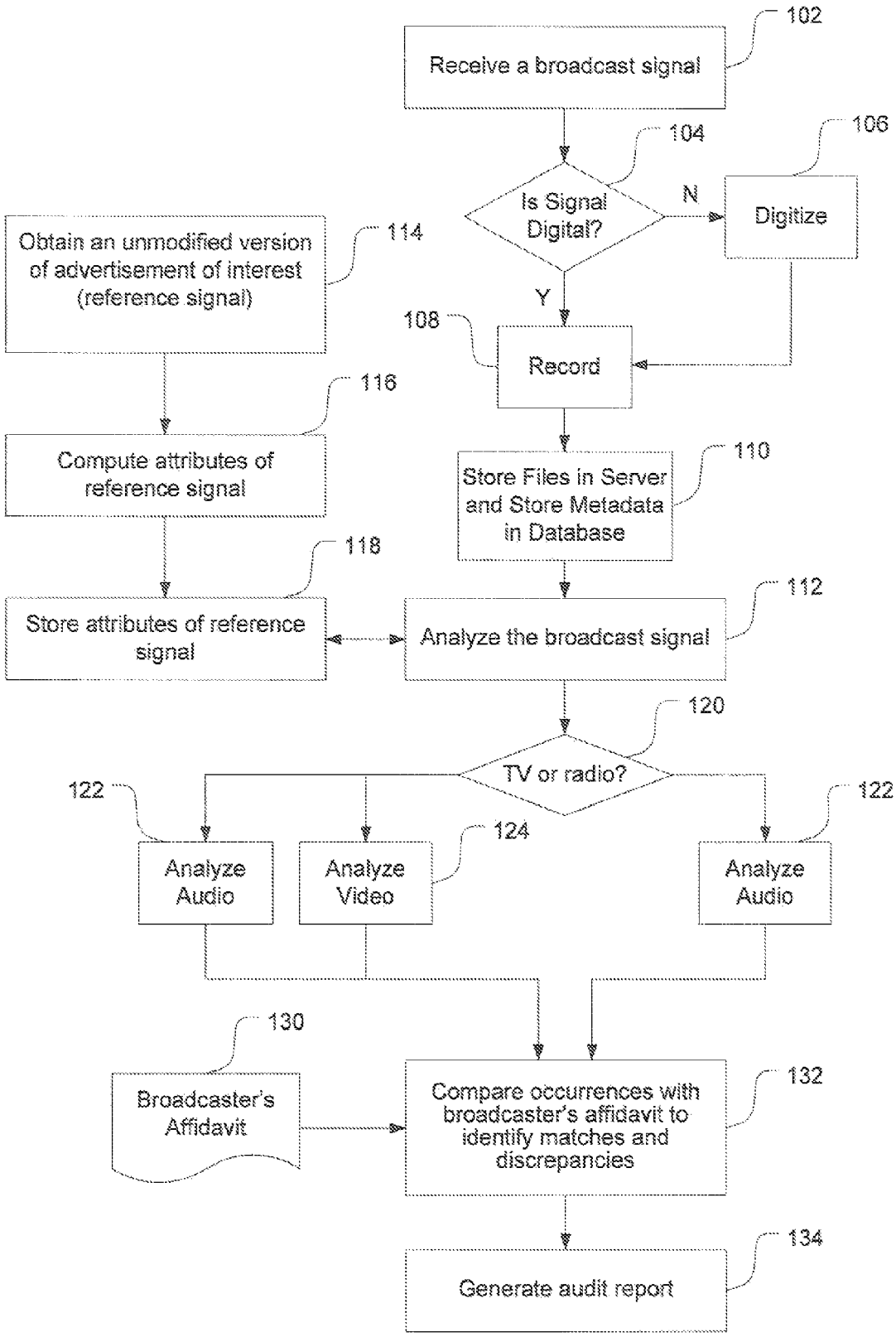
FIG. 3 is a flowchart depicting steps of a method of auditing a broadcaster's affidavit using the methodology of FIG. 2 in accordance with another embodiment of the present invention.

The automatically generated report can be used to provide an independent summary of advertising activity for a client or for that client's competitors (competitive intelligence). Alternatively, the report can be an audit of a broadcaster's affidavit, as depicted in FIG. 3. In this application, the broadcaster's affidavit is obtained (step 130) and the results of the audio and video analyses are used to compare (step 132) the occurrences ("matches" in terms of ad content and airing times) with the purported airing times for each of the ads detailed in the broadcaster's affidavit. An audit report would then be automatically generated (step 134) indicating whether the correct ad or ads aired at the correct times. Any discrepancies would be flagged. Optionally, where discrepancies are identified, the audit report could indicate the estimated dollar value differential between when the ad was supposed to air and when the ad actually aired. For example, if an advertiser pays for air time during a very popular show but the ad actually aired after the popular show ended, then (based on the estimated differential in the number of viewers) a dollar value can be estimated, representing the refund (or credit) that the advertiser would be entitled to request from the broadcaster. Thus, as is readily apparent, the ability to efficiently generate accurate audit reports has tremendous utility for tracking the fidelity of advertising.

Figure 4A:
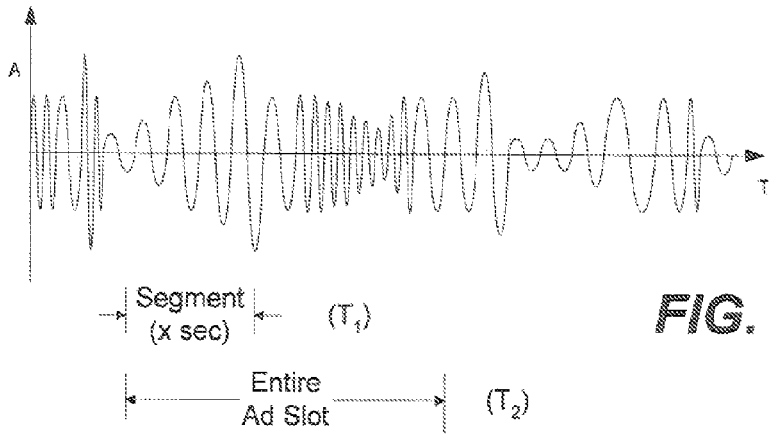
FIG. 4A is a representation of an audio signal carrying an advertisement of interest.
Figure 4B:
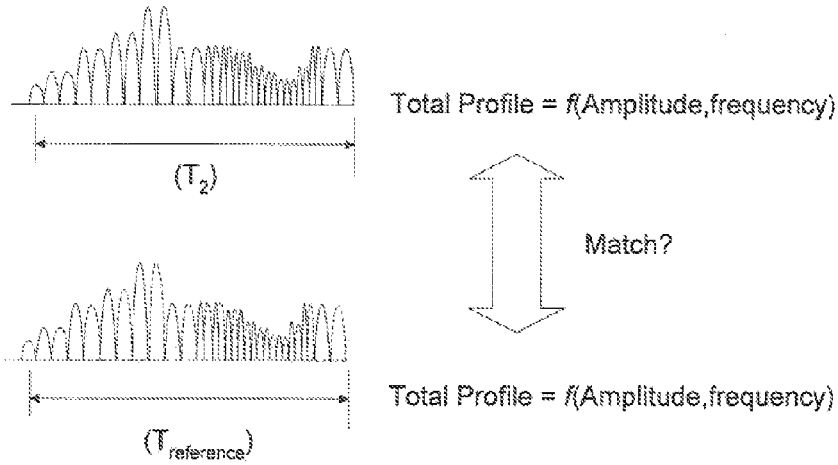
FIG. 4B is a schematic depiction of a tiered three-step methodology for analyzing the audio signal in accordance with an embodiment of the present invention.

FIGS. 4A and 4B schematically depict the preferred technique for performing the audio analysis. This is done for radio broadcast signals or for the audio component of a TV signal. As shown in FIG. 4A, a received broadcast signal is segmented into discrete, arbitrarily-sized segments, e.g. 12-second segments, although segments of other sizes can, of course, be defined. The audio signal is generally sinusoidal, with variations both in amplitude and frequency over a period of time. The audio signal is analyzed using a three-tiered threshold approach, meaning that progressively more accurate (and computationally intensive) techniques are applied to the signal if each successive test results in a potential match. In other words, analyzing the audio signal entails: (Step 1) performing a preliminary frequency analysis on a segment of the audio signal; if the preliminary frequency analysis indicates a potential match, then (Step 2) performing a total profile correlation taking into account both frequency and amplitude of the audio signal over the expected duration of the advertisement of interest; and if the total profile correlation still indicates the potential match, then (Step 3) performing a complete frequency analysis over a plurality of segments at least as long as an expected duration of the advertisement of interest.

The first step, as presented in FIG. 4, is to perform a quick (computationally efficient) check to see whether the first segment (i.e. the 12-second segment) matches the corresponding first 12-second segment of the reference signal. The first step is thus a simple (computationally expedient) frequency analysis that simply counts the number of peaks in one of a number of frequency bands. For the sake of illustration, the bands are presented as 10 Hz, 100 Hz, 1000 Hz and 10,000 Hz (to account for the human audible range which is between 20 Hz and 20 kHz). In other words, the preliminary frequency analysis entails performing a transform from the time domain into the frequency domain (to provide a frequency spectrum) and then counting the number of frequency peaks in the frequency spectrum in each broad category for the duration of the segment, i.e. how many peaks are in the 10's of Hertz (10-99 Hz), how many in the 100's of Hertz (100-999 Hz), how many in the 1000's of Hertz (1-9 kHz range), and how many in the 10,000's of Hertz (10-99 KHz range).

By way of example only, let us assume that the results of the preliminary frequency analysis are as tabulated in the first table of FIG. 4B. In this example, there are 5 detected peaks in the 10,000 Hz band, 22 detected peaks in the 1000 Hz band, 19 detected peaks in the 100 Hz band, 9 detected peaks in the 10 Hz band. (These numbers are presented for the sake of illustration only and do not necessarily represent actual numbers likely to be obtained for real ads.)

From the prior analysis of the same portion (first segment) of the reference signal, let us assume that the number of peaks in each of the 10 kHz, 1 kHz, 100 Hz and 10 Hz bands were 5, 23, 18, 9, respectively. Provided that the difference between the number of detected peaks and the number of peaks measured for the reference signal for each band does not exceed a predetermined tolerance (expressed either in absolute difference in the number of peaks or as a percentage deviation), then the analysis software will declare a potential match. In this particular example, two of the bands (the 1000 Hz band and the 100 Hz band) do not precisely match but the analysis software will declare that they do match if either the absolute value of the difference is less than a preset threshold (e.g. less than 2) and/or the deviation is less than a preset percentage deviation (e.g. less than 10%). In this example, for the 1000 Hz band, there is an absolute difference of only 1 (22 detected peaks versus 23 pre-measured peaks for the 1000 Hz band) and an absolute difference of 1 as well for the 100 Hz band (19 detected peaks versus 18 pre-measured peaks). The percentage deviations (4% for the 1000 Hz band and 5% for the 100 Hz band) are also within the tolerance. Thus, the analysis software would tentatively find that there is a potential match. It should be noted that these thresholds and tolerances are presented by way of example only, and do not necessarily represent actual thresholds for performing the analysis. Within the foregoing framework, the actual tolerances and thresholds need to be tweaked to be sufficiently sensitive to the particular signals to be analyzed.

In addition to the difference tolerances and percentage deviation computations, the analysis server performs a statistical correlation over a range of the obtained data (e.g. the entire detected segment or potentially only a subset thereof). As a further refinement, the analysis software can optionally treat any one mismatch as a statistical aberration, thus declaring a potential match even if there is one particular data mismatch or one particular failure of the data to correlate within acceptable statistical bounds. In other words, the analysis software can enable a user to adjust parameters and sensitivity settings to tweak the software to the particularities of a given broadcast media, broadcaster or signal type.

If the preliminary frequency analysis (Step 1) indicates a potential match, then the second step of this audio analysis entails performing a total profile correlation taking into account both frequency and amplitude of the audio signal over the expected duration of the advertisement of interest. This is a computationally more intensive step than the preliminary analysis and thus to be performed only when the previous threshold test has been met. This step takes into account not only the frequency distribution but also the amplitude variation of the signal by computing a "signature" for the profile. If the profile's signature matches the signature of the profile of the reference signal, then the method proceeds to the third (and final) step.

If the correlation analysis continues to suggest a potential match, then the third and final step is a complete frequency analysis over, for example, an entire 30-second duration of the advertisement, i.e. a complete frequency analysis over a plurality of segments at least as long as an expected duration of the advertisement of interest. This second step thus entails determining the numbers of detected peaks at the various frequency bands for the entire duration of the ad. Again, let us assume that the results of the complete frequency analysis indicate that there are 12, 47, 40 and 21 detected peaks in the 10 kHz, 1 kHz, 100 Hz and 10 Hz bands and that the number of pre-measured peaks from the reference signal were 12, 48, 39 and 21. Again, by applying a absolute difference tolerance and/or a percentage tolerance, the analysis software determines whether statistically there is a match. The tolerances and allowable deviations for the complete frequency analysis can be the same as for the preliminary frequency analysis or they can be more stringent. Again, a statistical correlation can be performed on the data to provide a further check.

By testing for potential matches in three progressively more accurate yet computationally intensive stages, an excellent trade-off between efficiency and accuracy is achieved. In order words, the first step provides a rough check that is computationally efficient so that large volumes of data can be sifted electronically without getting bogged down, yet without sacrificing accuracy (i.e. without the risk that an ad is missed). The second step is more computationally intensive, but is only applied to a small fraction of all of the data, i.e. only the data files where a potential match exists after a first segment is analyzed. Finally, the third (and most computationally intensive) stage is only reached when both the first and second thresholds are met, which represents a very small fraction of all the data, and is essentially a thorough verification that the potential match is definitely a match.

For a radio signal, the analysis would end at this point. The report would be automatically generated showing whether the ad was aired at the correct time (or not). In the case of video (e.g. TV or streaming internet or Webcasting), it is of course necessary to verify that the video component is also identical as it is possible that a different ad uses the same audio but different video.

Figure 5A:
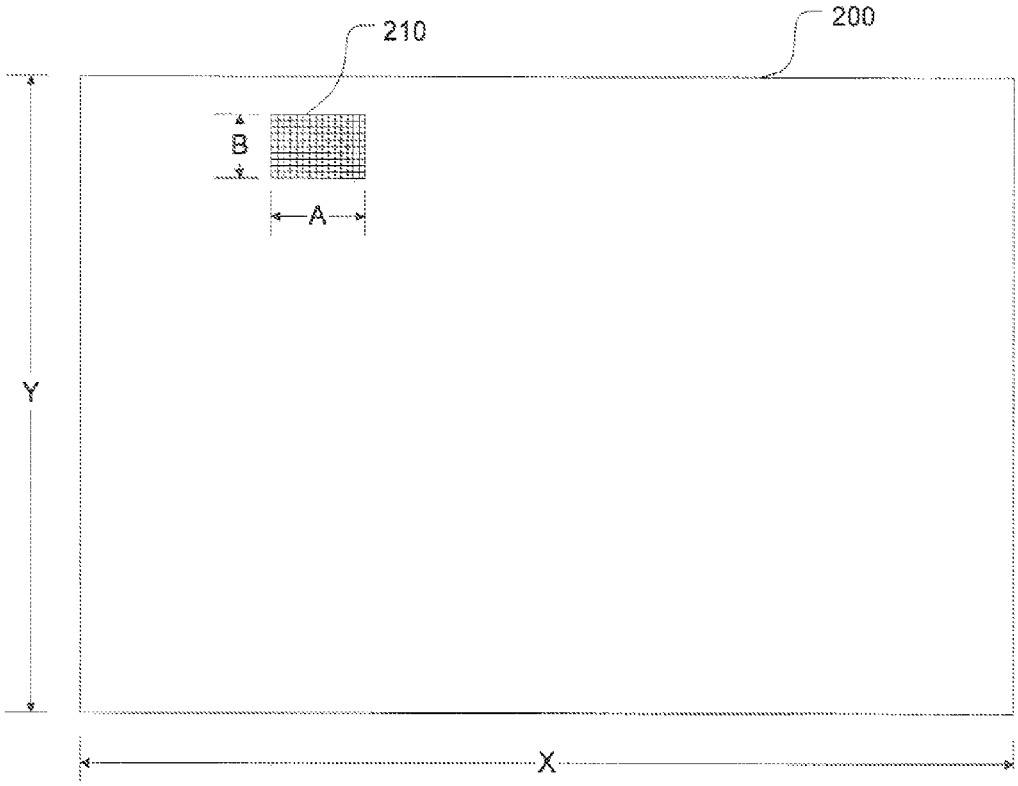
FIG. 5A is a schematic depiction of a two-dimensional array of pixels used as the basis for computing chromaticity and luminance values for a video frame.
Figure 5B:
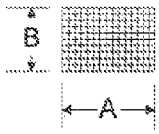
FIG. 5B presents a summary of luminance and chromaticity comparisons used for determining whether the video frame matches that of the reference signal.

Video analysis is presented schematically in FIGS. 5A and 5B. In FIG. 5A, a video frame 200 having X by Y pixels of resolution is subdivided into arbitrarily sized arrays of A by B pixels. Due to the computational intractability of analyzing the frame pixel by pixel (especially in view of phase shifts on channels) averaging is performed over the A-by-B arrays. In other words, once the video frame 200 is subdivided into arrays 210, the arrays are compared both in terms of luminance (greyscale brightness) and chromaticity (red, blue, and green color content). Each array of the detected signal is compared to the corresponding array of the reference signal by determining how much red, blue, green and luminance is present. Thus a total of eight variable are obtained: that is, for each of the three colors and for luminance (essentially a black/white characteristic), both a deviation and a statistical correlation are computed. For example, the deviation can be expressed as a percentage tolerance. The comparison proceeds array by array, with eight variables being compared and correlated for each array. Thus, each array can be declared a match and so, if all or at least a very high number of arrays in the video frame match, then the frame can be declared a match. This proceeds for each of the video frames in the segment and then for the entire duration of the ad. As a variant, a coarser granularity for the arrays can be defined which would enable a first rapid pass through a segment of video frames to establish a potential match. Then, if a potential match is identified, the granularity can be tightened for a second verification pass through the segment. As a further variant, the number of passes (tiers) can be user-configurable in the analysis software to enable a user to obtain optimal performance from the system for particular signal characteristics.

For the purposes of this specification, the expressions "an unmodified version of the advertisement" means that the ad has not been modified by insertion of a fingerprint, watermark, dither or other such marker. With the present technology, the reference signal is an "unmodified signal", containing no watermarks, fingerprints or dithers. The present technology can positively identify an ad of interest by comparing the unmodified signal received from the broadcast with the unmodified reference signal corresponding to the ad of interest.

The present technology can be used to monitor and verify ads, commercials, promotional segments and the like on television, on the radio, or on the Internet (either from a Website or in a Webcast). By digitizing/scanning analog media, it is possible to apply this to print media, magazines, although it should be understood that the main use of this technology is for TV and radio where the ads are carried on a broadcast signal.

Once the analysis is complete, one or more reports can be generated either in hardcopy (on paper) or in electronic format. Electronic reports can be uploaded to a secure web server accessible by the client, e-mailed directly to the client, or mailed on CD-ROM, or combinations thereof. These electronic reports can be generated automatically from the results of the analysis (although human oversight to double-check an anomalous results may be prudent).

Figure 6:
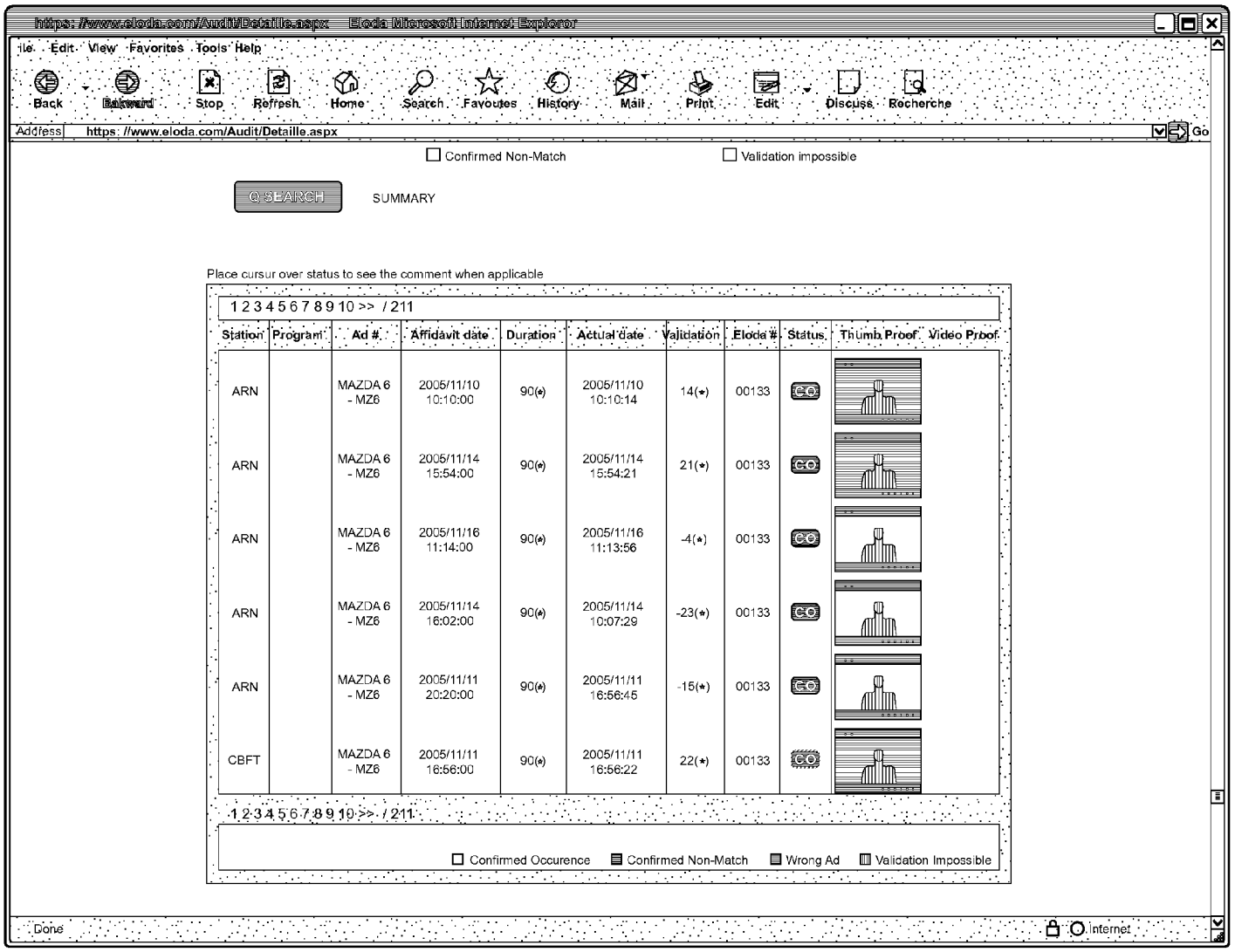
FIG. 6 is a screenshot of a browser interface presenting an online report that includes thumb proofs and/or video proofs of the advertisement of interest.

FIG. 6 is a screenshot of a browser interface presenting an online report that includes "thumb proofs" and/or "video proofs" of the advertisement of interest, as will be explained in greater detail below. The electronic report displayed in the browser interface presented in FIG. 6 includes conveys a variety of information to the client about the ad, its content, and timing (for either auditing, verifying, monitoring, or competitive intelligence). For example, the report includes the identification of the station (channel) on which the ad aired, the program that was airing at that time, the ad number, the affidavit date (and time), the duration of the ad, its actual date (and time) of airing, the variation or deviation between the affidavit date and time and the actual date and time, a file reference number of the author of the report (in this case, Eloda Inc.'s internal file reference), the status (e.g. CO for "Confirmed Occurrence", CN for "Confirmed Non-Match", WA for "Wrong Ad", and VI for "Validation Impossible") with a legend showing at the bottom of the screen.

As further depicted in FIG. 6, the report can include an electronic proof embedded within the report, i.e. either a "thumb proof" and/or a "video proof" embedded within the report. A thumb proof includes at least one time-stamped thumbnail of a video frame extracted from a broadcast signal carrying the advertisement of interest. Optionally, the channel identification is also stamped on each video frame. This thumb proof serves as "electronic proof" that the video frames of the ad of interest in fact aired as these are captured and embedded from the received signal (after being re-sized to thumbnail size, of course).

The electronic proof could also be a video proof comprising downloadable time-stamped video frames extracted from a broadcast signal carrying the advertisement of interest. The client would then simply click on the hyperlink to play (or fast-forward through) a sequence of video frames captured from the signal broadcast. Preferably, these video frames are not only time-stamped but also contain an indication of the channel on which the advertisement was aired. This channel ID is simply electronically stamped on each frame like the timestamp.

In a preferred implementation, the electronic report is generated by including both the thumb proof and the video proof. Alternatively, when a client contracts to have an audit or verification done, the client can be presented with options to have either the thumb proof or the video proof or both.

In summary, therefore, the foregoing technology enables a novel and innovative method of verifying advertising that includes the steps of comparing a received instance of an advertisement of interest (e.g. a target ad carried on a broadcast signal) to a reference advertisement and then automatically generating an electronic report (e.g. a web report) indicating whether the received instance of the advertisement of interest matches the reference advertisement (e.g. after performing the various analyses described earlier). The automatically-generated electronic report includes an electronic proof (thumb proof or video proof or both) embedded within the report, the electronic proof being extracted from the received instance of the advertisement of interest. In other words, one or more video frames are extracted with the timestamp and channel ID, downsized to thumbnails, and then embedded into the report for viewing/downloading by the client. Automatically generating these reports for online viewing by clients provides timely and commercially valuable information to advertisers in an efficient and cost-effective manner.

The embodiments of the invention described above are intended to be exemplary only. The scope of the invention is therefore intended to be limited solely by the scope of the appended claims.

Copyright Notice

A portion of the disclosure of this patent document may contain material that is subject to copyright protection. The copyright owner has no objection to the facsimile reproduction by anyone of the patent document or patent disclosure, as it appears in the Patent and Trademark Office patent file or records, but otherwise reserves all copyright.

The invention claimed is:

1. A method of automatically verifying airing times and content of advertising carried out by a digital computer system, the method comprising steps of:

receiving a broadcast signal upon which an advertisement of interest is scheduled to be carried, the broadcast signal comprising a TV signal including both an audio signal and a video signal;

analyzing the broadcast signal by comparing detected attributes of the broadcast signal with previously measured attributes of a reference signal representing an unmodified version of the advertisement of interest in order to determine whether the broadcast signal contains the advertisement of interest, the step of analyzing the broadcast signal comprises analyzing both the audio signal and the video signal by performing a preliminary frequency analysis on a segment of the audio signal, if the preliminary frequency analysis indicates a potential match, then performing a total profile correlation taking into account both frequency and amplitude of the audio signal over the expected duration of the advertisement of interest;

if the total profile correlation still indicates the potential match, then performing a complete frequency analysis over a plurality of segments at least as long as an expected duration of the advertisement of interest; and generating a report indicating whether the broadcast signal contained the advertisement of interest.

2. The method as claimed in claim 1 wherein the step of receiving the broadcast signal comprises a step of digitizing an incoming analog signal.

3. The method as claimed in claim 1 further comprising a step of storing the broadcast signal in at least one computer database for storing files after receiving the broadcast signal.

4. The method as claimed in claim 2 further comprising a step of storing the broadcast signal after receiving the broadcast signal.

5. The method as claimed in claim 1 wherein the step of analyzing the video signal comprises a step of performing both a difference tolerance and a correlation analysis for both luminance and chromaticity for arbitrarily defined constituent arrays of pixels for each video frame.

6. A method of automatically verifying airing times and content of advertising carried out by a digital computer system, the method comprising steps of:

receiving a broadcast signal upon which an advertisement of interest is scheduled to be carried, the broadcast signal comprises an audio signal;

analyzing the broadcast signal by comparing detected attributes of the broadcast signal with previously measured attributes of a reference signal representing an unmodified version of the advertisement of interest in order to determine whether the broadcast signal contains the advertisement of interest, the step of analyzing the broadcast signal comprises the steps of:

performing a preliminary frequency analysis on a segment of the audio signal;

if the preliminary frequency analysis indicates a potential match, then performing a total profile correlation taking into account both frequency and amplitude of the audio signal over the expected duration of the advertisement of interest; and if the total profile correlation still indicates the potential match, then performing a complete frequency analysis over a plurality of segments at least as long as an expected duration of the advertisement of interest; and generating a report indicating whether the broadcast signal contained the advertisement of interest.

7. The method as claimed in claim 1 wherein the step of analyzing the broadcast signal comprises a step, performed by the digital computer system, of determining whether the advertisement of interest exactly matches the content of the unmodified version of the advertisement of interest.

8. The method as claimed in claim 1 wherein the step of analyzing the broadcast signal comprises a step, performed by the digital computer system, of determining whether the advertisement of interest aired at exactly an expected time.

9. The method as claimed in claim 6 wherein the step of analyzing the broadcast signal comprises a step of determining whether the advertisement of interest aired at exactly an expected time.

10. The method as claimed in claim 1 wherein the step of generating the report comprises generating an audit report by the digital computer system based upon a broadcaster's affidavit by:

determining whether detected airing times and ad content match the airing times and ad content detailed in the broadcaster's affidavit; and presenting in the report any discrepancies between the airing times and ad content actually detected and the airing times and ad content detailed in the broadcaster's affidavit.

11. The method as claimed in claim 1 wherein the step of generating the report comprises detailing in the report the airing times and ad content for one or more ads being carried on one or more monitored channels.

12. The method as claimed in claim 1 wherein the step of generating the report comprises generating a competitive intelligence report in the report by presenting information about the airing times and ad content of advertisements placed by a specified competitor.

13. The method as claimed in claim 1 wherein the step of generating the report comprises a step of generating an electronic report through the digital computer system having a thumb proof embedded in the report, the thumb proof being a thumbnail of a video frame extracted from the advertisement of interest.

14. The method as claimed in claim 1 wherein the step of generating the report comprises a step of generating an electronic report displayable through a browser interface having a thumb proof embedded in the report, the thumb proof being a thumbnail of a video frame extracted from the advertisement of interest and wherein the thumb proof comprises a timestamp and an indication of a channel on which the advertisement of interest was aired.

15. The method as claimed in claim 1 wherein the step of generating the report comprises a step of generating an electronic report having a video proof embedded in the report, the video proof comprising a link to enable a client to download and view video frames from the advertisement of interest.

16. The method as claimed in claim 1 wherein the step of generating the report comprises a step of generating an electronic report having a video proof embedded in the report, the video proof comprising a link to enable a client to download and view video frames from the advertisement of interest and wherein the video proof comprises a timestamp on each video frame and an indication of a channel on which the advertisement of interest was aired.

17. The method as claimed in claim 1 wherein the step of generating the report comprises a step of generating an electronic report having both a thumb proof and a video proof, wherein the thumb proof is a thumbnail of a time-stamped video frame extracted from the advertisement of interest and wherein the video proof comprises a link to enable a client to download and view time-stamped video frames of the advertisement of interest.

18. The method as claimed in claim 1 wherein the step of generating the report comprises a step of uploading the report to a web server to enable a client to securely access the report using a browser and wherein the report comprises a thumb proof and a video proof, wherein the thumb proof is a thumbnail of a time-stamped video frame extracted from the advertisement of interest and wherein the video proof comprises a link to enable a client to download and view time-stamped video frames of the advertisement of interest.

19. A computer program product comprising code adapted to perform the steps of any one of claims 1 to 18 when the computer program product is loaded into a memory of one or more servers and executed by processors resident within the one or more servers.

20. A system for automatically monitoring and verifying advertisements, the system comprising:

a recorder for recording a received broadcast signal, the broadcast signal comprising a TV signal including both an audio signal and a video signal;

a first database for storing digital files corresponding to discrete arbitrarily sized segments of the signal and a second database for storing metadata characterizing each digital file;

a controller for dispatching the stored digital files from the first database to an analysis server for analyzing the broadcast signal by comparing detected attributes of the broadcast signal with previously measured attributes of a reference signal representing an unmodified version of the advertisement of interest in order to determine whether the broadcast signal contains the advertisement of interest to enable generation of a report indicating whether the signal contains the advertisement of interest, the analysis server executes analysis software that analyzes a video signal of a TV signal by performing both a difference tolerance and a correlation analysis for both luminance and chromaticity for arbitrarily defined constituent arrays of pixels for each video frame;

the analysis software also analyzes an audio signal of the TV signal by performing a preliminary frequency analysis on a segment of the audio signal;

if the preliminary frequency analysis indicates a potential match, then performing a total profile correlation taking into account both frequency and amplitude of the audio signal over the expected duration of the advertisement of interest;

if the total profile correlation still indicates the potential match, then performing a complete frequency analysis over a plurality of segments at least as long as an expected duration of the advertisement of interest.

21. The system as claimed in claim 20 further comprising a digitizer for digitizing an incoming analog signal.

22. A system for automatically monitoring and verifying advertisements, the system comprising:

a recorder for recording a received broadcast signal;

a first database for storing digital files corresponding to discrete arbitrarily sized segments of the signal and a second database for storing metadata characterizing each digital file;

a controller for dispatching the stored digital files from the first database to an analysis server for analyzing the broadcast signal by comparing detected attributes of the broadcast signal with previously measured attributes of a reference signal representing an unmodified version of the advertisement of interest in order to determine whether the broadcast signal contains the advertisement of interest to enable generation of a report indicating whether the signal contains the advertisement of interest, the analysis server executes analysis software that analyzes the audio signal of a radio signal by:

performing a preliminary frequency analysis on a segment of the audio signal;

if the preliminary frequency analysis indicates a potential match, then performing a total profile correlation taking into account both frequency and amplitude of the audio signal over the expected duration of the advertisement of interest; and if the total profile correlation still indicates the potential match, then performing a complete frequency analysis over a plurality of segments at least as long as an expected duration of the advertisement of interest.

23. The system as claimed in claim 20 wherein the analysis server executes analysis software to automatically generate the report.

24. The system as claimed in claim 20 further comprising a report generation server connected to the analysis server for generating the report.

25. The system as claimed in claim 20 wherein the report is an audit report based upon a broadcaster's affidavit, the audit report specifying whether detected airing times and ad content match the airing times and ad content detailed in the broadcaster's affidavit.

26. The system as claimed in claim 20 wherein the report comprises details of airing times and ad content for one or more ads being carried on one or more monitored channels.

27. The system as claimed in claim 20 wherein the report is a competitive intelligence report presenting information about the airing times and ad content of advertisements placed by a specified competitor.

* * * * *

UNITED STATES PATENT AND TRADEMARK OFFICE

CERTIFICATE OF CORRECTION

PATENT NO. : 7,627,878 B2
APPLICATION NO. : 11/613822
DATED : December 1, 2009
INVENTOR(S) : Jean-Francois Pouliot et al.

It is certified that error appears in the above-identified patent and that said Letters Patent is hereby corrected as shown below:

On the Title Page Item (73) Assignee: "Eloda Inc." should read -- Eloda Corporation --.

Signed and Sealed this

Fifth Day of October, 2010

David J. Kappos

David J. Kappos
*Director of the United States Patent and Trademark Office*